US007809295B2

(12) United States Patent
Yasukawa et al.

(10) Patent No.: US 7,809,295 B2
(45) Date of Patent: Oct. 5, 2010

(54) COLOR IMAGE FORMING APPARATUS AND METHOD FOR STABILIZING LIQUID DEVELOPER VISCOSITY

(75) Inventors: Shinji Yasukawa, Suwa (JP); Nobuhiro Miyakawa, Ashiya (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 483 days.

(21) Appl. No.: 11/875,734

(22) Filed: Oct. 19, 2007

(65) Prior Publication Data

US 2008/0138101 A1 Jun. 12, 2008

(30) Foreign Application Priority Data

Dec. 8, 2006 (JP) ..... 2006-331280
Aug. 30, 2007 (JP) ..... 2007-223894

(51) Int. Cl.
*G03G 15/00* (2006.01)

(52) U.S. Cl. ..... 399/57; 399/237

(58) Field of Classification Search ..... 399/57, 399/58, 237, 239

See application file for complete search history.

(56) References Cited

U.S. PATENT DOCUMENTS 5,821,041 A * 10/1998 Okutsu et al. ..... 430/440
2004/0105702 A1* 6/2004 Kurotori et al. ..... 399/237

FOREIGN PATENT DOCUMENTS

JP 09-026704 1/1997
JP 2001-075365 3/2001
JP 2001075365 A * 3/2001

OTHER PUBLICATIONS

Machine English Translation of JP2001075365.*

* cited by examiner

*Primary Examiner*—David M Gray
*Assistant Examiner*—Billy J Lactaoen
(74) *Attorney, Agent, or Firm*—Hogan Lovells US LLP

(57) ABSTRACT

A color image forming apparatus includes, for each of liquid developers of plural colors, a photosensitive member, a developing roller, an agitating device that agitates a liquid developer having a viscosity characteristic dependent on a shearing force, and a developer supplying unit that supplies the liquid developer to the developing roller. In development, agitation start timing is varied depending on the color of the liquid developer.

12 Claims, 7 Drawing Sheets

COLOR IMAGE FORMING APPARATUS AND METHOD FOR STABILIZING LIQUID DEVELOPER VISCOSITY

BACKGROUND

1. Technical Field

The present invention relates to color image forming apparatuses such as a copying machine, a facsimile, and a printer and color image forming methods, and, more particularly to a color image forming apparatus and a color image forming method for forming a thin layer of a high-viscosity and high-density liquid developer on a developer carrying member in liquid developing means, bringing the liquid developer layer on the developer carrying member into contact with the surface of an image supporting member, and visualizing an electrostatic latent image on the image supporting member formed by electrophotography, electrostatic recording, ion flow, or the like.

2. Related Art

An image forming system that forms an image using a liquid developer has advantages that, for example, a fine toner in a sub-micron size can be used, a high-definition image quality can be realized, and a sufficient image density can be obtained with a small quantity of toner. These advantages cannot be realized by an image forming system that forms an image using a powder toner.

As the liquid developer, for example, there is known a liquid developer obtained by dispersing a toner in a volatile carrier liquid (JP-A-9-26704). In this patent document, it is described that a driving member is idled before a development operation to bring the driving member into a preparatory driving state in order to prevent occurrence of a coarse toner and occurrence of the adhesion and the like of the driving member due to vaporization of the carrier liquid. However, as long as the volatile carrier liquid is used, even if the driving member is brought into the preparatory driving state, it is difficult to prevent, for example, the adhesion to the surface of a transfer belt and the surface of a cleaning member in addition to the adhesion of the driving member.

When a nonvolatile high-viscosity and high-density liquid developer is used, the problems in the volatile carrier liquid can be prevented. However, as described in JP-A-2001-75365, the accumulation of the liquid developer and the swell of developer particle components occur in a developing unit. As in JP-9-26704, it is described that the developing unit is pre-driven before a development operation to solve the problems and normally recover a developing ability.

However, it has been found that, when a liquid developer that has a viscosity characteristic dependent on a shearing force and is obtained by dispersing a basic processed pigment in a vegetable oil according to an acid-base interaction is used as the nonvolatile liquid developer, even if a shearing force of agitation or the like is applied to the liquid developer to stabilize the viscosity in the liquid developer, stabilization time is different in respective colors and the viscosity in the liquid developer is different in the respective colors assumingly because the correlation between the pigment and a dispersant affects the stabilization. In such a liquid developer, since the use of the dispersant substantially affects an electric resistance in the liquid developer, when the electric resistance is set to the same degree in the respective colors as a premise, the difference in the viscosity is inevitable. When liquid developers of the respective colors are used for printing in a state in which the viscosity is unstable, the thickness of the liquid developers is not stable. Therefore, at an initial stage, a film is formed thick on a developing roller, an image section has density different from the original density, and thin lines are broken. Even if the viscosity is stabilized, the viscosity may be different in the respective colors. Therefore, uniform toner thin layers of the respective colors cannot be formed on respective developing rollers and it is difficult to adjust a color balance when color image formation is performed.

SUMMARY

An advantage of some aspects of the invention is to provide a color image forming apparatus and a color image forming method that use a liquid developer that has a viscosity characteristic dependent on a shearing force and obtained by dispersing a basic processed pigment in a vegetable oil according to an acid-base interaction, wherein a print quality can be stabilized in respective colors and stable color reproducibility can be realized.

According to an aspect of the present invention, a color image forming apparatus includes, for each of liquid developers of plural colors, a photosensitive member, a developing roller, an agitating device that agitates a liquid developer having a viscosity characteristic dependent on a shearing force, and developer supplying means for supplying the liquid developer to the developing roller. In development, agitation start timing is varied depending on the color of the liquid developer.

In the color image forming apparatus, image formation is started after the agitation of the liquid developer, and agitation of a liquid developer of a color having a longer stabilization time than that of another color is started earlier to stabilize the viscosities in the liquid developers of the plural colors.

The developing roller is driven in association with the agitating device, separated from the photosensitive member during non-development, and, during development, brought into contact with the photosensitive member after the viscosities in the liquid developers of the plural colors are stabilized.

The developing roller is in contact with the photosensitive member.

In the color image forming apparatus, during standby before development, an agitation speed of an agitating member in the agitating device is lower than an agitation speed of the agitating member during image formation.

An agitation speed of the liquid developer having a first transition time for transition of the liquid developer to stabilized viscosity is higher than an agitation speed of the liquid developer having a second transition time for transition to stabilized viscosity shorter than the first transition time.

Agitation speeds of the agitating devices of the respective colors are the same.

The developer supplying means has an anilox roller for supplying the liquid developer to the developing roller, irregularities are provided on the surface of the anilox roller, and a film thickness of the liquid developer on the developing roller is adjusted according to the viscosity of the liquid developer stabilized by the agitating device.

The liquid developers are liquid developers of cyan, magenta, yellow, and black obtained by dispersing a basic processed pigment in a vegetable oil according to an acid-base interaction.

The viscosities (at 25° C.) of the respective developers of cyan, magenta, yellow, and black are 100 mPa·s to 1500 mPa·s.

A first color image forming method according to another aspect of the invention is a color image forming method in a color image forming apparatus including, for each of liquid developers of plural colors, a photosensitive member, a developing roller, an agitating device that is driven in association with the developing roller and agitates a liquid developer having a viscosity characteristic dependent on a shearing force, and developer supplying means for supplying the liquid developer to the developing roller. The color image forming method includes, during development, supplying the respective liquid developers to respective developing rollers after starting the agitation of the liquid developer, and starting agitation of a liquid developer of a color having a longer stabilization time than that of another color earlier to stabilize the viscosities in the liquid developers of the plural colors, separating the developing roller from the photosensitive member during non-development, and, during development, bringing the developing roller into contact with the photosensitive member to develop an electrostatic latent image after changing the viscosities in the liquid crystal developers of the plural colors to printable viscosities.

A second color image forming method according to an aspect of the invention is a color image forming method in a color image forming apparatus including, for each of liquid developers of plural colors, a photosensitive member, a developing roller that comes into contact with the photosensitive member, an agitating device that is driven in association with the developing roller and agitates a liquid developer having a viscosity characteristic dependent on a shearing force, and developer supplying means for supplying the liquid developer to the developing roller. The color image forming method includes, during development, supplying the respective liquid developers to respective developing rollers after starting the agitation of the liquid developer, and starting agitation of a liquid developer of a color having a longer stabilization time than that of another color earlier to stabilize the viscosities in the liquid developers of the plural colors.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
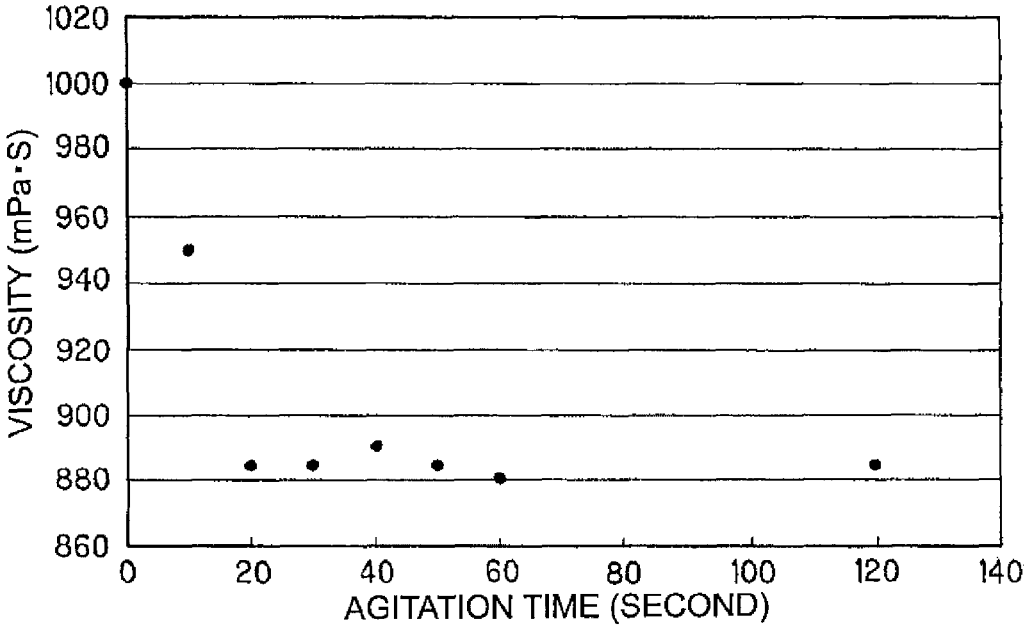
FIGS. 1A and 1B are diagrams showing viscosity characteristics in a cyan liquid developer and a yellow liquid developer in an example.

A liquid developer according to an embodiment of the invention is obtained by dispersing a basic processed pigment in a vegetable oil according to an acid-base interaction. For example, the liquid developer is a positively charged liquid developer obtained by dispersing a basic process pigment, an acid polymeric dispersant, and the like in a vegetable oil and has a viscosity characteristic dependent on a shearing force.

Examples of a vegetable oil usable as a carrier liquid include a soybean oil, a safflower oil, a sunflower oil, a corn oil, a cotton oil, a rapeseed oil, and a linseed oil. Fats and fatty oils are triglyceride that is ester including one molecule of glycerin and three molecules of aliphatic acid. However, it is known that an ester exchange oil with a characteristic of fats and fatty oils changed by causing alcohol or aliphatic acid to react to triglyceride is obtained. Such an ester exchange oil is also included in the vegetable oil according to the embodiment of the invention.

In the liquid developer according to the embodiment of the invention, a toner and a carrier are consumed together when an electrostatic latent image is developed. In particular, when triglyceride that has an aliphatic acid composition with a high ratio of unsaturated bond of an oleic acid, a linolic acid, a linolenic acid, and the like is used as a carrier liquid, since oxidation polymerization is caused, a toner image can be solidified on transfer paper. Therefore, fixing means can be simplified. As the vegetable oil of the carrier liquid, a vegetable oil including a rapeseed oil containing 60 mass % or more of linolic acid components in aliphatic acid forming triglyceride, a vegetable oil including a safflower oil, a sunflower oil, a soybeans oil, a corn oil, and a cotton oil containing 50 mass % or more of linolic acid components, and a vegetable oil including a linseed oil containing 50 mass % or more of linolenic acid components are preferable.

As a pigment in the base processed pigment, there are an inorganic pigment and an organic pigment. Examples of the inorganic pigment include furnace black, acetylene black, and channel black, which are carbon black, Printex G, Printex V, Special black 4, and Special black 4-B (manufactured by Degussa Ltd.), Mitsubishi #44, #30, MA-11, and MA-100 (manufactured by Mitsubishi Carbon Co., Ltd.), Raven 30, Raven 40, and Conductex SC (manufactured by Colombia Carbon Co., Ltd.), and Regal 400, Regal 660, Regal 800, and Black pearl L (Manufactured by Cabot Corporation), which are sold on the market. Inorganic white pigments of zinc oxide, titanium oxide, silicon oxide and the like may be used.

Examples of the organic pigment include phthalocyanine blue, phthalocyanine green, rhodamine lake, malachite green lake, methyl violet lake, peacock blue lake, naphthol green B, permanent red 4R, Hansa yellow, benzidine yellow, and thioindigo red. In terms of a color index number, examples of the cyan pigment include Pigment Blue 15:3 and Pigment Blue 15, examples of the magenta pigment include Pigment Red 57:1 and Pigment Red 185, and examples of the yellow pigment include Pigment Yellow 74 and Pigment Yellow 17.

The basic processed pigment is obtained by processing the pigments described above using resin and basic polymeric dispersants described below under the presence of methyl ethyl ketone and water. Examples of the resin used for processing the pigments include one or two or more kinds of resin selected out of polyester resin, ethylene-vinyl acetate copolymer, styrene-acryl resin, rosin modified resin, polyethylene, ethylene acrylate copolymer, ethylene maleic anhydride copolymer, polyvinylpyridine, polyvinylpyrrolidone, ethylene methacrylic acid copolymer, and ethylene acrylic acid copolymer. Examples of the basic polymeric dispersant include Ajisper PB-822 manufactured by Ajinomoto-Fine-Techno Co., Inc., Hinoact 7000 manufactured by Kawaken Fine Chemicals Co., Ltd., and SOLSPER 32000 manufactured by Avecia Biologics, Ltd.

The basic processed pigment is obtained by processing 100 parts by mass of a pigment with 150 to 1000 parts by mass of resin and 5 to 200 parts by mass of the basic polymeric dispersant. In the liquid developer, it is advisable that the basic processing pigment is contained at a ratio of 8 mass % to 50 mass % and, preferably, 10 mass % to 40 mass %.

The oleic acid added in the liquid developer is a higher unsaturated aliphatic acid that alone has a liquid property at the room temperature. It is advisable that the oleic acid is added for the purpose of viscosity adjustment and charge control for the liquid developer. It is advisable that the oleic acid is contained at a ratio of 5 mass % to 60 mass % and, preferably, 10 mass % to 50 mass % in the liquid developer.

The acid polymeric dispersant is added for the purpose of improving a dispersion property of the basic pigment in the liquid developer. Examples of the acid polymeric dispersant include Ajisper PA111 manufactured by Ajinomoto-Fine-Techno Co., Inc., KF-10000 manufactured by Kawaken Fine Chemicals Co., Ltd., and Alpharesin SA-300 manufactured by Alpha Kaken Co., Ltd. It is advisable that the acid polymeric dispersant is contained at a ratio of 0.1 mass % to 1 mass % and, preferably, 0.2 mass % to 0.5 mass % in the liquid developer.

A charge control agent can be mixed in the positively charged liquid developer according to the embodiment of the invention. Examples of the charge control agent include titan chelate such as tetraethyl titanate, tetraisopropyl titanate, tetra-n-propyl titanate, tetra-n-butyl titanate, tetra-tert-butyl titanate, tetra-2-ethylhexyl titanate, tetraoctyl titanate, tetramethoxy titan, and titanylacetylacetate. Other examples of the charge control agent include titanate coupling agents such as isopropyl trisisostearoyl titanate, isopropyl tridecylbenzene sulfonyl titanate, isopropyl tri-(dioctylpyrophosphate) titanate, tetraisopropyl bis-(dioctylphosphite) titanate, tetraoctyl bis-(ditridecyl phosphate) titanate, tetra-(2,2-diallyloxydimethyl-1-butyl)bis-(ditridecyl), bis-(dioctylpyrophosphate) ethylene titanate, isopropyl triocatnoyl titanate, isopropyl dimetacrylic isostearyl titanate, isopropyl isostearyl diacritic titanate, isopropyl tri-(dioctylphospate) titanate, isopropyl tricumylphenyl titanate, and isopropyl tri-(N-aminoethyl-aminoethyl)titanate. Besides, an antioxidant, an age resistor, an ultraviolet absorber, and the like may be contained in the liquid developer according to the embodiment of the invention.

A toner density of the liquid developer according to the embodiment of the invention is set to 5 mass % to 40 mass % by mixing the basic processed pigment, the acid polymeric dispersant, and the like in the carrier liquid of the vegetable oil. The liquid developer is dispersed by an attritor, a sand mill, a ball mill, an oscillating mill, or the like to be prepared such that a primary particle diameter (an average particle diameter) of toner particles (colored particulates) is about 1 μm.

From the viewpoint of a function of the liquid developer, the developer according to the embodiment of the invention is prepared such that an electric resistance (at 25° C.) is $1.0\times10^{10}$ Ω·cm to $5\times10^{13}$ Ω·cm. It is advisable that the liquid developer is prepared such that the viscosity (at 25° C.) in a long-time untouched and stable state is in a range of 100 mPa·s to 1500 mPa·s and, preferably, 200 mPa·s to 1000 mPa·s and is set to be 100 mPa·s to 900 mPa·s by applying a shearing force at agitation speed of 100 mm/s to 600 mm/s.

Figure 1B:
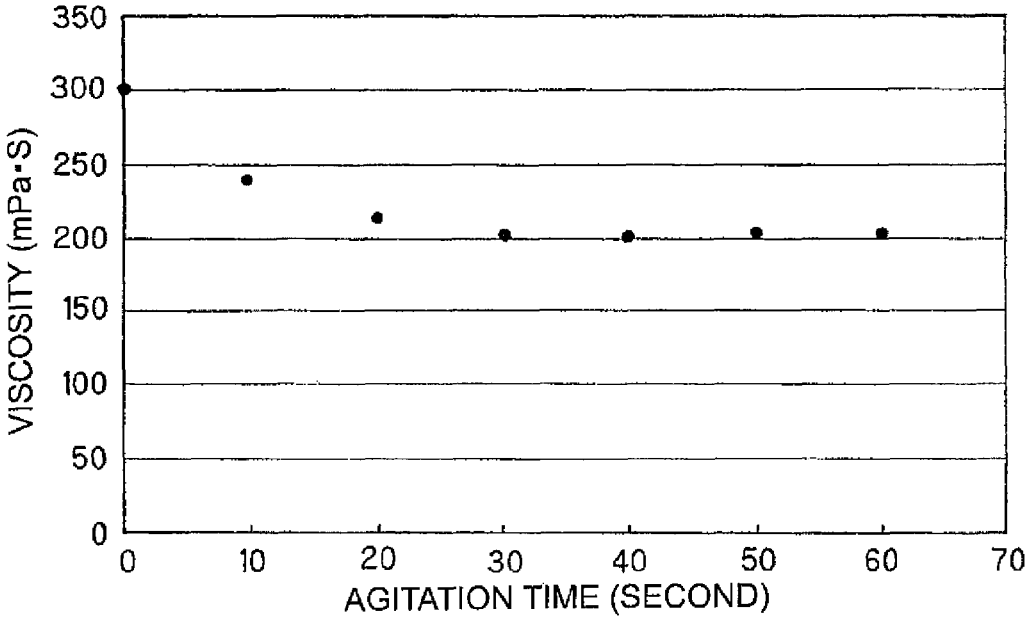

As shown in FIGS. 1A and 1B, the liquid developer according to the embodiment of the invention has a viscosity characteristic dependent on a shearing force. When the shearing force at agitating speed described above is applied to the liquid developer in the long-time untouched state by an agitating screw or the like in the developing device, the viscosity gradually falls and, before long, falls to a saturated state and stabilizes. When the shearing force is removed and the liquid developer is left untouched again, the viscosity gradually increases and, before long, increases to a saturated state and stabilizes. The viscosities of the developers of the respective colors increase to the maximum viscosities in a saturated state when the developers are left untouched for about at least eight hours. For example, in the cyan toner in FIG. 1A, when a shearing force at agitation speed of 200 mm/s is applied, the viscosity falls in twenty seconds and stabilizes at 885 mPas. In the yellow toner in FIG. 1B, when the same shearing force is applied, the viscosity falls in thirty seconds and stabilizes at 200 mPas.

In the developer according to the embodiment of the invention, the dispersion of the pigment is performed using the relation of the acid-base interaction. A large quantity of the polymeric dispersant cannot be added because the polymeric dispersant affects an electric resistance in the liquid developer. However, even if the same quantity of the polymeric dispersant is added for the respective pigments taking into account a dispersion property, viscosities after being left untouched, stabilization times until the viscosities stabilizes in a state in which a shearing force is applied, and viscosities in a stabilized state after application of a shearing force are different in the respective colors assumingly because the interaction with the polymeric dispersant are different in the respective pigments. In other words, the liquid developer according to the embodiment of the invention not only has the viscosity characteristic dependent on a shearing force but also has a viscosity characteristic that stabilization times of viscosities under the application of a shearing force and values of viscosities under the application of the shearing force, i.e., at a development stage are different. It has been found that a high-quality color image cannot be formed simply by uniformly agitating the developers before development.

Overviews of a color image forming apparatus and a color image forming method according to an embodiment of the invention are explained with reference to FIGS. 2 and 3. Timing charts according to the embodiment are explained with reference to FIGS. 4 to 7.

Figure 2:
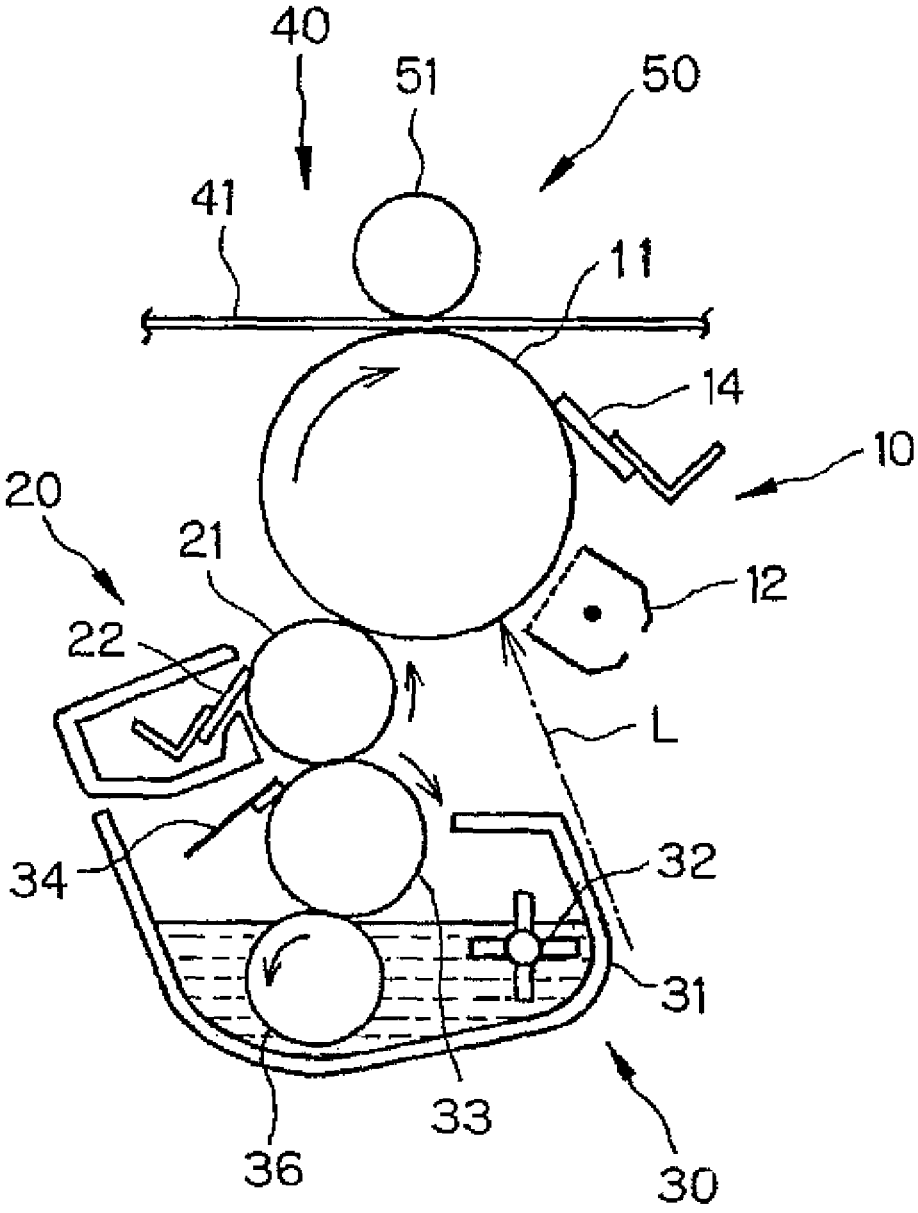
FIG. 2 is a diagram for explaining an overview of an image forming apparatus including a liquid developing device.

FIG. 2 is a diagram for explaining an overview of an image forming apparatus including a liquid developing device 20. In an image forming unit 10, a charging device 12, the developing device 20, an intermediate transfer unit 40, and a photosensitive drum cleaning blade 14 as an example of an image bearing member cleaning device are arranged along a rotating direction of an outer circumference of a photosensitive drum 11 as an example of an image bearing member.

In the liquid developing device 20, a developing roller cleaning blade 22 as an example of a developing member cleaning device and a developer supplying device 30 are arranged on an outer circumference of a developing roller 21 as an example of a developing member. The developer supplying device 30 has a liquid developer container 31, an agitating screw 32 as an example of an agitating device, an anilox roller 33 as an example of a developer supplying member, and a regulating blade 34 as an example of a regulating member. A liquid developer, the agitating screw 32, the anilox roller 33, the regulating blade 34, and a draw-up roller 36 are housed in the liquid developer container 31. In a position of the intermediate transfer unit 40 opposed to the photosensitive drum 11, a primary transfer roller 51 of a primary transfer unit 50 is arranged via an intermediate transfer belt 41 as an example of an intermediate transfer member.

The photosensitive drum 11 is formed of a cylindrical member that is wider than the developing roller 21 and on an outer circumferential surface of which a photosensitive layer is formed. The photosensitive drum 11 rotates in a clockwise direction by not-shown driving means. The charging device 12 is arrange further on an upstream side in the rotating direction of the photosensitive drum 11 than a nip section between the photosensitive drum 11 and the developing roller 21. The charging device 12 uniformly charges the photosensitive drum 11 with corona discharge in the dark. As the charging device 12, besides the charging device for charging the photosensitive drum 11 with corona discharge, a charging device of a system for applying a predetermined charging bias to a charging roller or the like set in contact with the photosensitive drum 11 may be used.

The photosensitive drum cleaning blade 14 comes into contact with the surface of the photosensitive drum 11 to scrape and remove a residual developer, which is mainly a carrier liquid, on the photosensitive drum 11 after passing the primary transfer unit. The surface of the photosensitive drum 11 is initialized by this removal of the residual developer.

It is advisable to provide an ultraviolet curing resin film containing fluorine on the surface of a photoconductive layer in the photosensitive drum with thickness not hindering image formation and adjust volatility of the film such that a contact angle with respect to a vegetable oil on the surface of the photosensitive drum is 60° to 80°. Consequently, it is possible to prevent the liquid developer from adhering to a non-image section. By adopting such a photosensitive member, it is possible to reduce adhesion of the liquid developer to the non-image section even in a development operation.

In the developing device 20, the developing roller 21, the developing roller cleaning blade 22, the developer supplying device 30, and the like are disposed. The developer supplying device 30 has the liquid developer container 31, the agitating screw 32, the anilox roller 33, the regulating blade 34, and the like. In the liquid developer container 31, the liquid developer, the agitating screw 32, the anilox roller 33, the regulating blade 34, and the draw-up roller 36 are housed.

The liquid developer is stored in the liquid developer container 31. The agitating screw 32 has a shearing force applied to the liquid developer. The agitating screw 32 is disposed to be immersed in the liquid developer in the container and is driven to rotate by the not-shown driving means. The agitating screw 32 rotates according to timing charts shown in FIGS. 4 to 7 and the liquid developer in the developer container 31 is agitated. As agitating means, an agitating roller and the like may be used. In agitation, it is advisable to set agitation speed to 100 mm/s to 600 mm/s and, preferably, 300 mm/s to 600 mm/s to apply a shearing force to the liquid developer.

The anilox roller 33 is a cylindrical member and rotates in a clockwise direction in FIG. 2. An irregular surface having fine and uniformly spiral grooves is formed on the surface of the anilox roller 33 to easily carry the developer supplied from the draw-up roller 36 on the surface. As dimensions of the grooves, a groove pitch is about 130 μm and can be varied in a range of 70 μm to 150 μm. A groove depth is about 30 μm and can be varies in a range of 15 μm to 60 μm. The liquid developer is supplied from the developer container 31 to the developing roller 21 by the anilox roller 33.

By adjusting the groove depth in the anilox roller 33 for each of the colors according to the viscosities of the liquid developers of the respective colors under the application of a shearing force, it is possible to adjust the film thicknesses of the liquid developers of the respective colors on the developing roller 21 given by the anilox roller 33 to, for example, an identical thickness and adjust a color balance. It goes without saying that, if the viscosities of the liquid developers of the respective colors under the application of a shearing force are adjusted to the same degree, it is unnecessary to adjust the groove depth in the anilox roller 33 for each of the colors.

The regulating blade 34 is formed of a spring material of phosphor bronze having a rubber piece attached to the tip thereof or metal such as stainless steel. The regulating blade 34 comes into contact with the rotating anilox roller 33 to scrape off the liquid developer on the anilox roller 33. When the liquid developer is scraped off in this way, a quantity of the liquid developer on the anilox roller 33 is accurately calculated as a value corresponding to a capacity of plural recesses of the anilox roller 33. Therefore, a quantity of the liquid developer supplied to the developing roller 21 is adjusted. The rotating direction of the anilox roller 33 is not limited to an arrow direction shown in FIG. 2 and may be the opposite direction. When the anilox roller 33 rotates in the opposite direction, the regulating blade 34 needs to be arranged according to the rotating direction.

The developing roller 21 is a cylindrical member and rotates counterclockwise around a rotation axis as shown in the figure. In the developing roller 21, a conductive elastic layer formed of urethane rubber or the like is provided on an outer circumference thereof. The developing roller 21 develops an electrostatic latent image on the photosensitive drum 11 with the developer supplied from the anilox roller 33. The developing roller cleaning blade 22 is elastically formed of metal, rubber, or the like that comes into contact with the surface of the developing roller 21. The developing roller cleaning blade 22 is arranged further on a downstream side in the rotating direction of the developing roller 21 than a development nip section where the developing roller 21 comes into contact with the photosensitive drum 11. The developing roller cleaning blade 22 scrapes off and removes the liquid developer remaining on the developing roller 21. The removed developer is stored in the developer container 31 through a feedback section. In this embodiment, the developing roller cleaning blade 22 is applied as the developing member cleaning device. However, the developing member cleaning device is not limited to this and a roller and the like may be used.

It is advisable to perform, at a stage when a print operation (a development operation) is finished, density management for fixing a liquid level (density) in the liquid developer container 311 in which the liquid developer is stored, detect a light transmission density, set a viscometer, and supply a concentrated toner or a carrier liquid (a vegetable oil) to adjust the liquid developer to the respective color densities (liquid levels). In this way, it is possible to reduce an adjustment time at the start of the next development operation.

After the electrostatic latent image on the photosensitive member 11 is developed, in the primary transfer unit 50, the primary transfer roller 51 and the photosensitive drum 11 are arranged to be opposed to each other across the intermediate transfer member 41. With a position of contact with the photosensitive drum 11 set as a transfer position, the primary transfer unit 50 transfers a developed toner image on the photosensitive drum 11 onto the intermediate transfer belt 41 to form the toner image.

Figure 3:
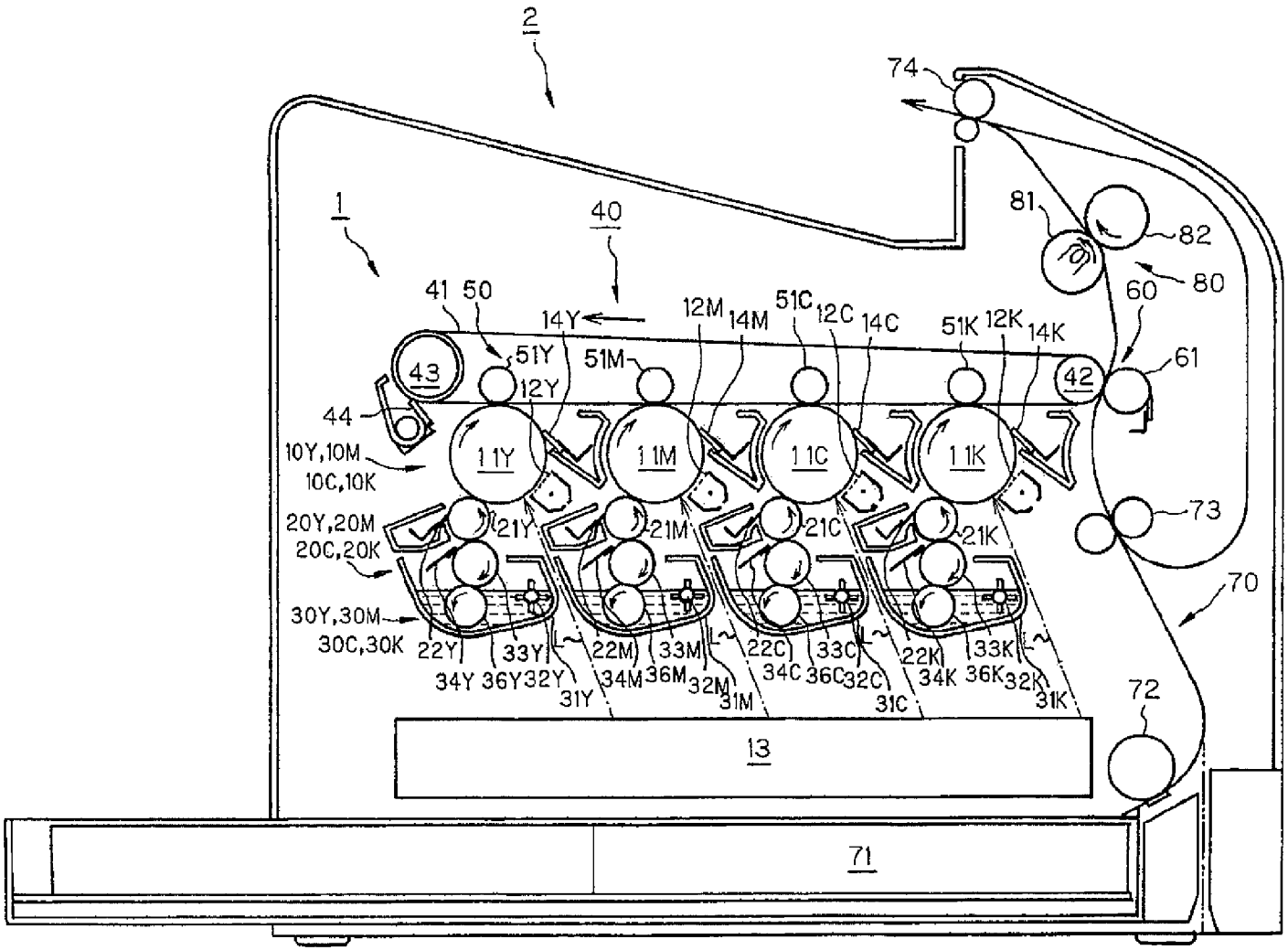
FIG. 3 is a diagram for explaining a color image forming apparatus of an embodiment of the invention in a tandem printer to which the liquid image forming apparatus in FIG. 2 is applied.

FIG. 3 is a diagram for explaining the color image forming apparatus and the color image forming method according to this embodiment in a tandem printer to which the image forming apparatus in FIG. 2 is applied.

In the color image forming apparatus according to this embodiment, a quartet of the image forming units 10 and a quartet of the developing devices 20 shown in FIG. 2 are arranged. In the image forming units 10 and the developing devices 20, images are formed by liquid developers of respective colors of yellow (Y), magenta (M), cyan (C), and black (K), respectively.

In the image forming units 10Y, 10M, 10C, and 10K, photosensitive drums 11Y, 11M, 11C, and 11K are uniformly charged by charging devices 12Y, 12M, 12C, and 12K. A modulated laser beam is irradiated on the basis of an inputted image signal according to exposure light L from exposing devices 13Y, 13M, 13C, and 13K, which have semiconductor lasers, polygon mirrors, and optical systems such as F-θ lenses, to form electrostatic latent images on the charged photosensitive drums 11Y, 11M, 11C and 11K.

Developing devices 20Y, 20M, 20C, and 20K develop the electrostatic latent images formed on the photosensitive drums 11Y, 11M, 11C, and 11K with the liquid developers of the respective colors of yellow (Y), magenta (M), cyan (C), and black (K).

Draw-up rollers 36Y, 36M, 36C, and 36K are driven to rotate by the not-shown driving means to draw up the liquid developers. The liquid developers are applied to anilox rollers 33Y, 33M, 33C, and 33K driven to rotate by the not-shown driving means. Regulating blades 34Y, 34M, 34C, and 34K come into contact with the rotating anilox rollers 33Y, 33M, 33C, and 33K to scrape off the liquid developers on the anilox rollers 33Y, 33M, 33C, and 33K. When the liquid developers are scraped off in this way, quantities of the liquid developers on the anilox rollers 33Y, 33M, 33C, and 33K are accurately calculated as values corresponding to capacities of plural recesses of the anilox rollers. As described above, it is possible to control applied film thicknesses of the liquid developers on the surfaces of the developing rollers by the capacity of the recess on the anilox roller surface. However, if the viscosities under the application of a shearing force in the respective colors are the same degree, it is unnecessary to control the applied film thicknesses.

The liquid developers scraped off by the regulating blades 34Y, 34M, 34C, and 34K are dropped and returned to the developer containers 31Y, 31M, 31C, and 31K by the gravity. The liquid developers not scraped off by the regulating blades 34Y, 34M, 34C, and 34K are stored in grooves of irregularities in the surfaces of the anilox rollers 33Y, 33M, 33C, and 33K. When the anilox rollers 33Y, 33M, 33C, and 33K come into press contact with the developing rollers 21Y, 21M, 21C, and 21K, the liquid developers are applied to the surfaces of the developing rollers 21Y, 21M, 21C, and 21K.

The developing rollers 21Y, 21M, 21C, and 21K come into contact with the photosensitive drums 11Y, 11M, 11C, and 11K while rotating at speed equal to that of the photosensitive drums and form development nips. In the development nips, development electric fields are formed by potential differences between the developing rollers 21Y, 21M, 21C, and 21K, to which a development bias of the same polarity as a charging polarity of the toners is applied from a not-shown power supply, and the photosensitive drums 11Y, 11M, 11C, and 11K.

Specifically, in the development nips, the developing rollers 21Y, 21M, 21C, and 21K and non-image sections of the photosensitive drums 11Y, 11M, 11C, and 11K, and the electrostatic latent images assume potentials of a polarity same as that of the toners, respectively. Values of the potentials are lower in an order of the non-image sections of the photosensitive drums 11Y, 11M, 11C, and 11K, the developing rollers 21Y, 21M, 21C, and 21K, and the electrostatic latent images.

Therefore, electric fields for electrostatically moving the toners to the developing rollers 21Y, 21M, 21C, and 21K having lower potentials are formed between the non-image sections of the photosensitive drums 11Y, 11M, 11C, and 11K and the developing rollers 21Y, 21M, 21C, and 21K. Electric fields for moving the toners to the electrostatic latent images on the photosensitive drums 11Y, 11M, 11C, and 11K having lower potentials are formed between the developing rollers 21Y, 21M, 21C, and 21K and the photosensitive drums 11Y, 11M, 11C, and 11K.

In the developing nips in which such development electric fields are formed, the toners in the developer thin layers electrophoretically move and gather to the surfaces of the developing rollers 21Y, 21M, 21C, and 21K between the developing rollers 21Y, 21M, 21C, and 21K and the non-image sections of the photosensitive drums 11Y, 11M, 11C, and 11K. Further, the toners electrophoretically move and adhere to the electrostatic latent images on the photosensitive drums 11Y, 11M, 11C, and 11K between the developing rollers 21Y, 21M, 21C, and 21K and the electrostatic latent images on the photosensitive drums 11Y, 11M, 11C, and 11K. When the toners adhere to the electrostatic latent images on the developing drums 11Y, 11M, 11C, and 11K in this way, the electrostatic latent images are developed to become toner images. Development densities may be adjusted by controlling development voltages for the respective colors between the developing rollers and the photosensitive drums.

The residual developers on the developing rollers 21Y, 21M, 21C, and 21K after passing the development nips are scraped off and removed when the developing roller cleaning blades 22Y, 22M, 22C, and 22K come into contact with the surfaces of the developing rollers 21Y, 21M, 21C, and 21K. When the residual developers are removed, the surfaces of the developing rollers 21Y, 21M, 21C, and 21K are initialized. The removed residual developers return to the developer containers 31Y, 31M, 31C, and 31K through feedback sections.

Subsequently, in primary transfer units 50Y, 50M, 50C, and 50K in which the photosensitive drums 11Y, 11M, 11C, and 11K and the primary transfer rollers 51Y, 51M, 51C, and 51K are arranged to be opposed to each other across the intermediate transfer belt 41, the photosensitive drums 11Y, 11M, 11C, and 11K pass nip sections between the photosensitive drums and the primary transfer rollers 51Y, 51M, 51C, and 51K across the intermediate transfer belt 41 as an example of the intermediate transfer member. With contact positions between the photosensitive drums 11Y, 11M, 11C, and 11K and the primary transfer rollers 51Y, 51M, 51C, and 51K as transfer positions, a polarity opposite to a charging polarity of toner particles is applied to the primary transfer rollers 51Y, 51M, 51C, and 51K. Consequently, the toners are primarily transferred from the photosensitive drums 11Y, 11M, 11C, and 11K onto the intermediate transfer belt 41, visual toner images of the respective colors are primarily transferred onto the intermediate transfer belt 41 to be superimposed one after another, and a full color toner image is formed.

Even if the liquid developers adhere to and remain on the photosensitive drums 11Y, 11M, 11C, and 11K, the liquid developers on the photoconductive drums 11Y, 11M, 11C, and 11K after the primary transfer are scraped off by photosensitive drum cleaning blades 14Y, 14M, 14C, and 14K further on a downstream side in the rotating direction of the photosensitive drums 11Y, 11M, 11C, and 11K than the primary transfer units 50Y, 50M, 50C, and 50K.

The toner images primarily transferred onto the intermediate transfer belt 41 in the primary transfer units SOY, 50M, 50C, and 50K proceed to a secondary transfer unit 60 and enter a nip section between a driving roller 42 and a secondary transfer roller 61 formed via the intermediate transfer belt 41. In the secondary transfer unit 60, the secondary transfer roller 61 and the driving roller 42 are applied with opposite polarities. Consequently, a single color toner image and a full color toner image formed on the intermediate transfer belt 41 are transferred onto a recording medium P as a transfer member such as a sheet, a film, a cloth, or the like conveyed by a recording medium conveying unit 70.

The secondary transfer unit 60 supplies the recording medium P to be timed to coincide with timing when the toner images superimposed on the intermediate transfer belt 41 reach a secondary transfer section and secondarily transfers the toner images onto the recording medium P. However, when a trouble in supply of the recording medium P such as jam occurs, the toner images come into contact with the secondary transfer roller 61 and are transferred onto the secondary transfer roller 61 in a state in which the recording medium P is not interposed. As a result, a rear surface of the recording medium P is stained.

As means for improving, even if the surface of the recording medium P is not smooth due to a fibrous material, a secondary transfer characteristic according to the non-smooth surface of the recording medium P, the secondary transfer roller 61 is constituted by an elastic roller. The elastic roller is coated with an elastic body on the surface thereof for a purpose same as that of an elastic belt adopted for the intermediate transfer belt 41 that primarily transfers and superimposes the toner images, which are formed on the plural photosensitive drums 11, one after another and secondarily transfers the toner images onto the recording medium P collectively. The secondary transfer roller cleaning blade 62 is provided as means for removing the liquid developer transferred onto the secondary transfer roller 61 and collects the developer from the secondary transfer roller 61. The collected developer is in a mixed color state and may include foreign matter such as paper powder.

After passing the secondary transfer unit 60, the intermediate transfer belt 41 proceeds to a driven roller 43. When a trouble in supply of the recording medium P such as jam occurs, the toner image is not always entirely transferred onto the secondary transfer roller 61 and collected. A part of the toner image remains on the intermediate transfer belt 41. In a usual secondary transfer process, the toner image on the intermediate transfer belt 41 is not secondarily transferred onto the recording medium P entirely. A secondary transfer residual of several percent occurs. For the next image formation, these two types of unnecessary toner images are cleaned by an intermediate transfer belt cleaning blade 44 as an example of an intermediate transfer member cleaning device arranged to be in contact with the intermediate transfer belt 41. Thereafter, the intermediate transfer belt 41 moves to the primary transfer units 50Y, 50M, 50C, and 50K again.

The intermediate transfer unit 40 includes the intermediate transfer belt 41, the driving roller 42, the driven roller 43, and the intermediate transfer belt cleaning blade 44. The secondary transfer unit 60 includes the secondary transfer roller 61 and the secondary transfer roller cleaning blade 62.

In the recording medium conveying unit 70, one of the recording media P such as paper stacked in a sheet feeding cassette 71 is separated by a sheet feeding roller 72 and fed to the secondary transfer unit 60 through, for example, a gate roller 73 that corrects skew and feed timing of the recording medium P. In the secondary transfer unit 60, the full color image is secondarily transferred onto the recording medium P. The recording medium P having the full color image secondarily transferred thereon passes a fixing device 80 including a heat roller 81 that generates heat from the inside thereof and a pressing roller 82 that has an elastic member such as rubber on the outside thereof. The full color image is pressed and fixed on the recording medium P while thermoplastic resin in the full color image is fused. Consequently, a desired image is obtained and the recording medium P is discharged from a printer main body 2 by a sheet discharging roller 74.

When the respective liquid developers of yellow (Y), magenta (M), cyan (C), and black (K) according to this embodiment are stored in the developer containers 31Y, 31M, 31C, and 31K and left untouched for a long time, for example, eight hours, original viscosity and a dispersion state change for each of the colors and only development inferior in a color balance can be performed in color development. Therefore, according to this embodiment, it has been found that it is possible to adjust the colors while reducing power consumption by grasping, in advance, conditions of agitation by the agitating screws having a shearing force enough for stabilizing the viscosities of the liquid developers of the respective colors and, on the basis of data of the condition, changing the numbers of revolutions, rotation times, and rotation start timing of agitating screws 32Y, 32M, 32C, and 32K and the like in development.

Figure 4:
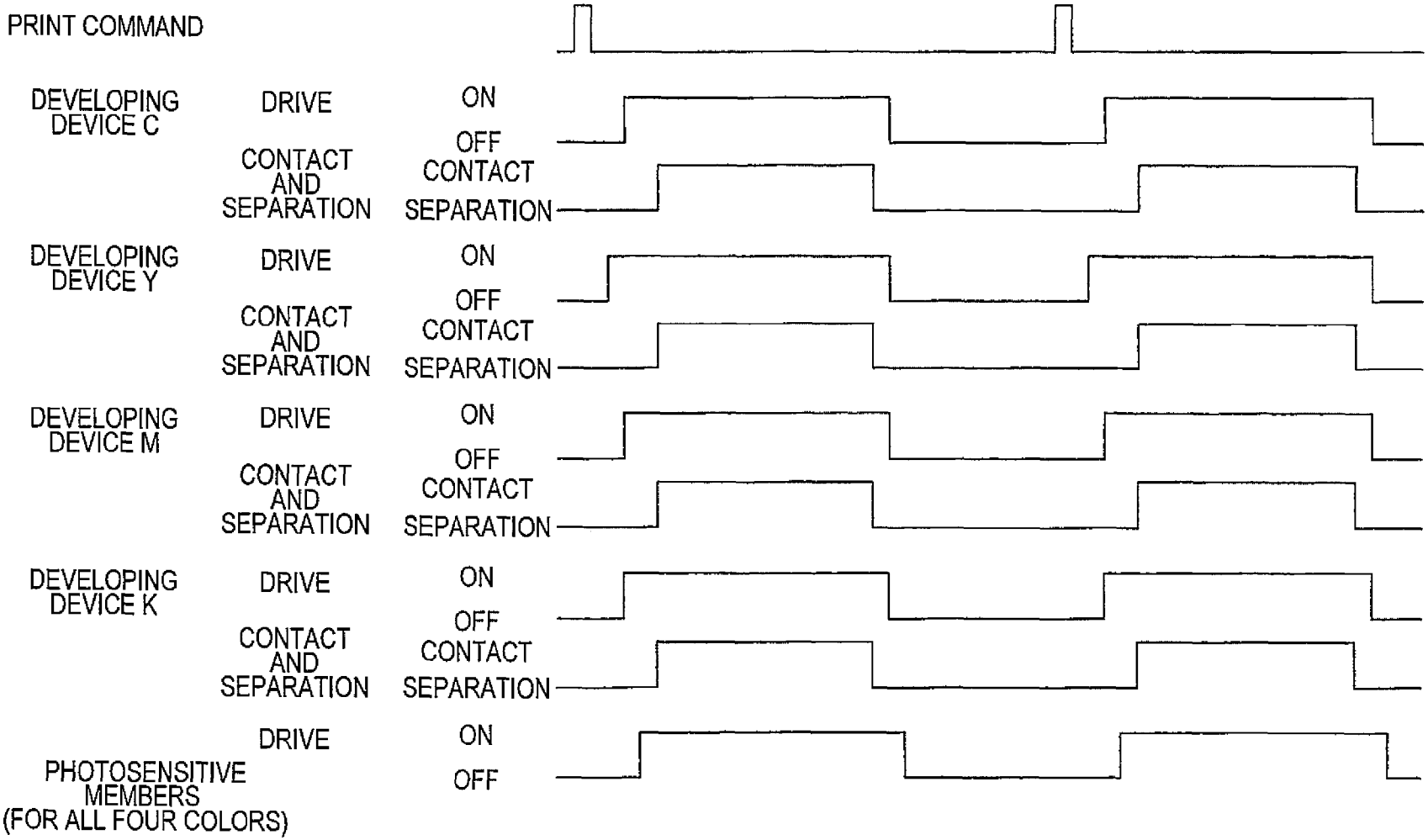
FIG. 4 is a diagram showing an example of a timing chart in the color image forming apparatus of an embodiment of the invention.

In FIG. 3, in some case, the photosensitive members 11 and the developing rollers 21 are allowed to separate from and come into contact with each other by a not-shown separation and contact mechanism and the agitating screws 32 and the developing rollers 21 are driven in association with each other. As the separation and contact mechanism for the photosensitive members 11 and the developing rollers 21, for example, a separation and contact mechanism described in JP-A-2006-184593 is applied. In stabilizing the viscosities of the liquid developers, the photosensitive members 11 and the developing rollers 21 are separated from each other and the agitating screws 32 are driven to stabilize the viscosities. In development, the developing rollers 21 and the photosensitive members 11 are brought into contact with each other. A timing chart for this operation is shown in FIG. 4.

In an example described later, when agitation speed of an agitating screw is set to 220 mm/s, a stabilization time in a yellow liquid developer is 30 seconds and stabilization times in a cyan liquid developer, a magenta liquid developer, and a black liquid developer are 20 seconds. In the following explanation, as an example, a stabilization time in the yellow liquid developer is the longest and stabilization times in the cyan liquid developer, the magenta liquid developer, and the black liquid developer are the same.

First, an operation of a C developing device is explained. When a print command for cyan development is issued, the cyan liquid developer is agitated in a state in which a C developing roller is separated from a photosensitive member. After the viscosity in the cyan liquid developer is stabilized, the developing roller 21 is brought into contact with the photosensitive member 11 while the agitation is continued and a development operation is started. When the development operation is finished, the developing roller 21 is separated from the photosensitive member 11 and the agitation driving of the C developing device is turned off. Development operations of a Y developing device, an M developing device, and a K developing device are the same as that of the C developing device.

In color development of the four colors, when a print command is issued, first, agitation in the Y developing device having the longest color stabilization time is started. Subsequently, after a fixed time, agitation in the C developing device, the M developing device, and the K developing device is started. In a state in which the viscosities in all the color liquid developers are stabilized, all the developing rollers are brought into contact with the respective photosensitive members 11 and the development operation is started while the agitation is continued. It is advisable to set the photosensitive members 11 of all the four colors in a driving state before all the developing rollers are brought into contact with the photosensitive members 11.

In the color image forming apparatus and the color image forming method described above, there is an advantage that the driving of the agitation screws and the driving of the developing rollers can be performed in association with each other and only one driving means is necessary.

Figure 5:
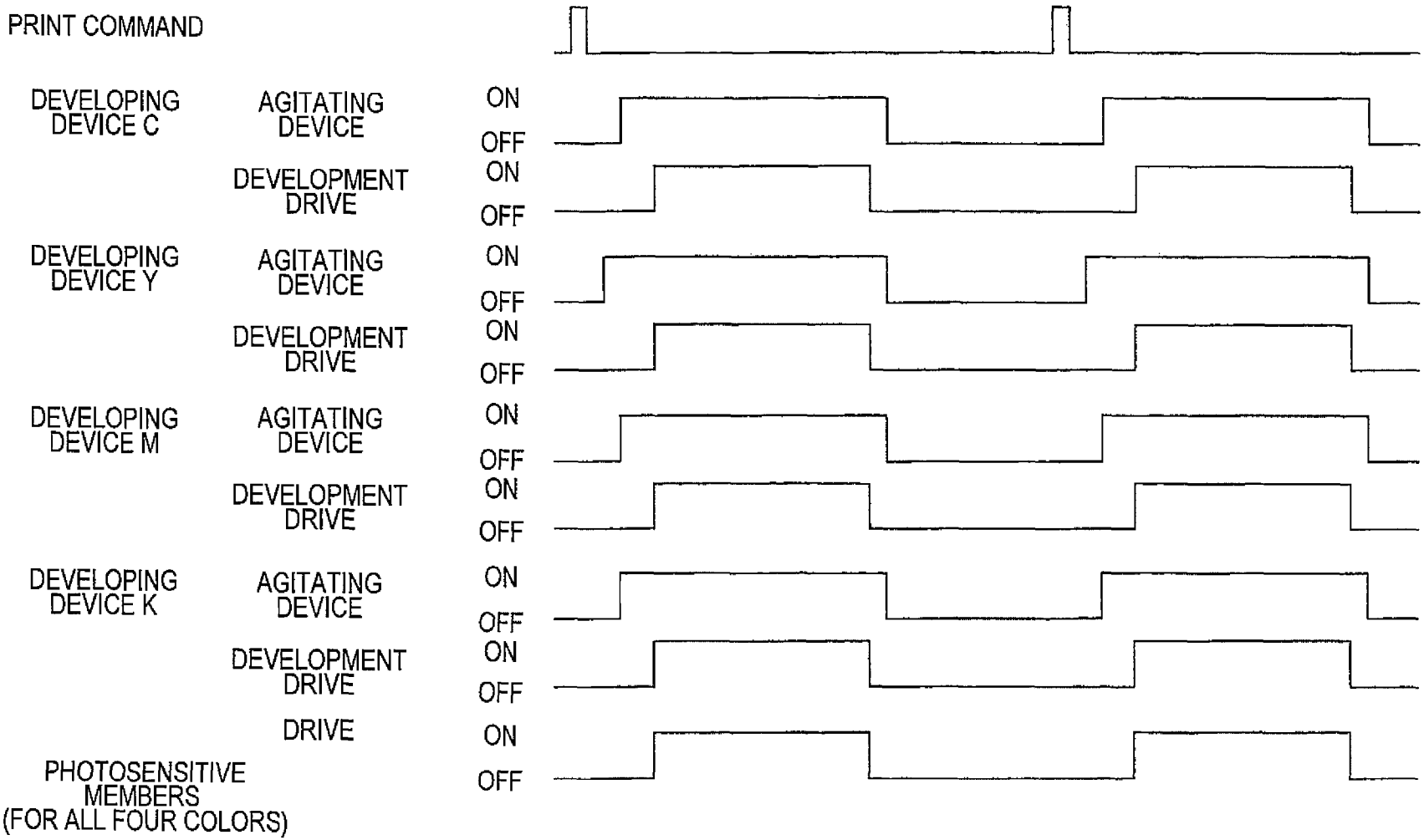
FIG. 5 is a diagram showing an example of a timing chart in the color image forming apparatus of an embodiment of the invention.

In the following explanation, the photosensitive members 11 and the developing rollers 21 are in a contact state and the agitating screws 32 and the developing rollers 21 can be driven independently from each other. A timing chart of the operation is shown in FIG. 5.

When a print command for cyan development is issued, the agitating screw 32 is driven (turned on). After the driving is continued for a fixed time and the viscosity in the cyan liquid developer is stabilized, the developing roller 21 is driven (turned on) and a development operation is started. When the development operation is finished, the driving of the development roller 21 is turned off and, then, the driving of the agitating screw 32 is turned off. The same operations are performed in the Y developing device, the M developing device, and the K developing device.

In color development of the four colors, when a print command is issued, first, agitation in the Y developing device having the longest color stabilization time is started. Subsequently, agitation is started in the C developing device, the M developing device, and the K developing device. After the liquid developers are agitated for a fixed time and the viscosities in the liquid developers of the respective colors are stabilized, the developing devices simultaneously drive all the developing rollers and start a development operation. It is advisable to bring the photosensitive members 11 of all the four colors into a driving state simultaneously with the developing rollers.

Figure 6:
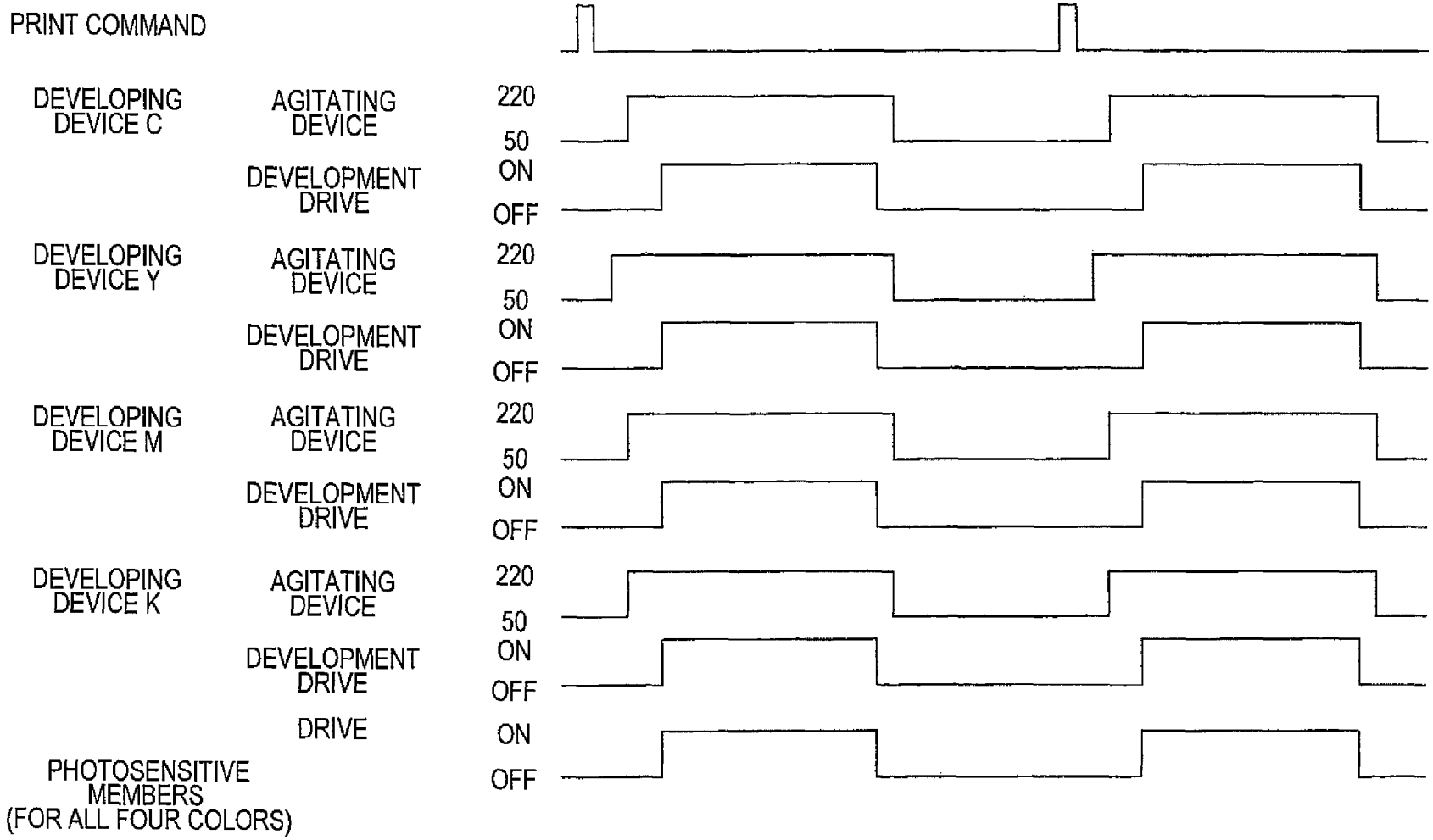
FIG. 6 is a diagram showing an example of a timing chart in the color image forming apparatus of an embodiment of the invention.

In a case shown in FIG. 6, during standby for development, for example, according to start operation in the color image forming apparatus, the liquid developers of the respective colors are agitated at the number of revolutions, for example, 50 mm/s, lower than the numbers of revolutions (220 mm/s) of the agitating screws during a print operation. By setting the numbers of revolutions of the agitating screws changeable, even if the numbers of revolutions of the agitating screws are set the same as that in the color image forming apparatus after a print command, it is possible to perform development in a short time and it is possible to reduce stabilization times in the liquid developers of the respective colors.

In the case of the C developing device, the C developing device is put on standby while the agitating screw is rotated at the number of revolutions of 50 mm/s. When a print command for only cyan is issued, after the number of revolutions of the agitating screw is changed to 220 mm/s and the viscosity is stabilized, the developing roller 21 is driven and a development operation is started. When the development operation is finished, the driving of the developing roller 21 is turned off and, then, the driving of the agitating screw 32 is turned off. The same operations are performed in the Y developing device, the M developing device, and the K developing device.

In color development of the four colors, when a print command is issued, first, the number of revolutions of the agitating screw 32 in the Y developing device is changed to 220 mm/s and, after a fixed time from that point, the numbers of revolutions of the agitating screws 32 in the C developing device, the M developing device, and the K developing device are changed. The agitating screws 32 are driven and the liquid developers are agitated. Driving of all the developing rollers is started after a fixed time while the agitation is continued. It is advisable to bring the photosensitive members 11 of all the four colors into a driving state simultaneously with all the developing rollers.

Figure 7:
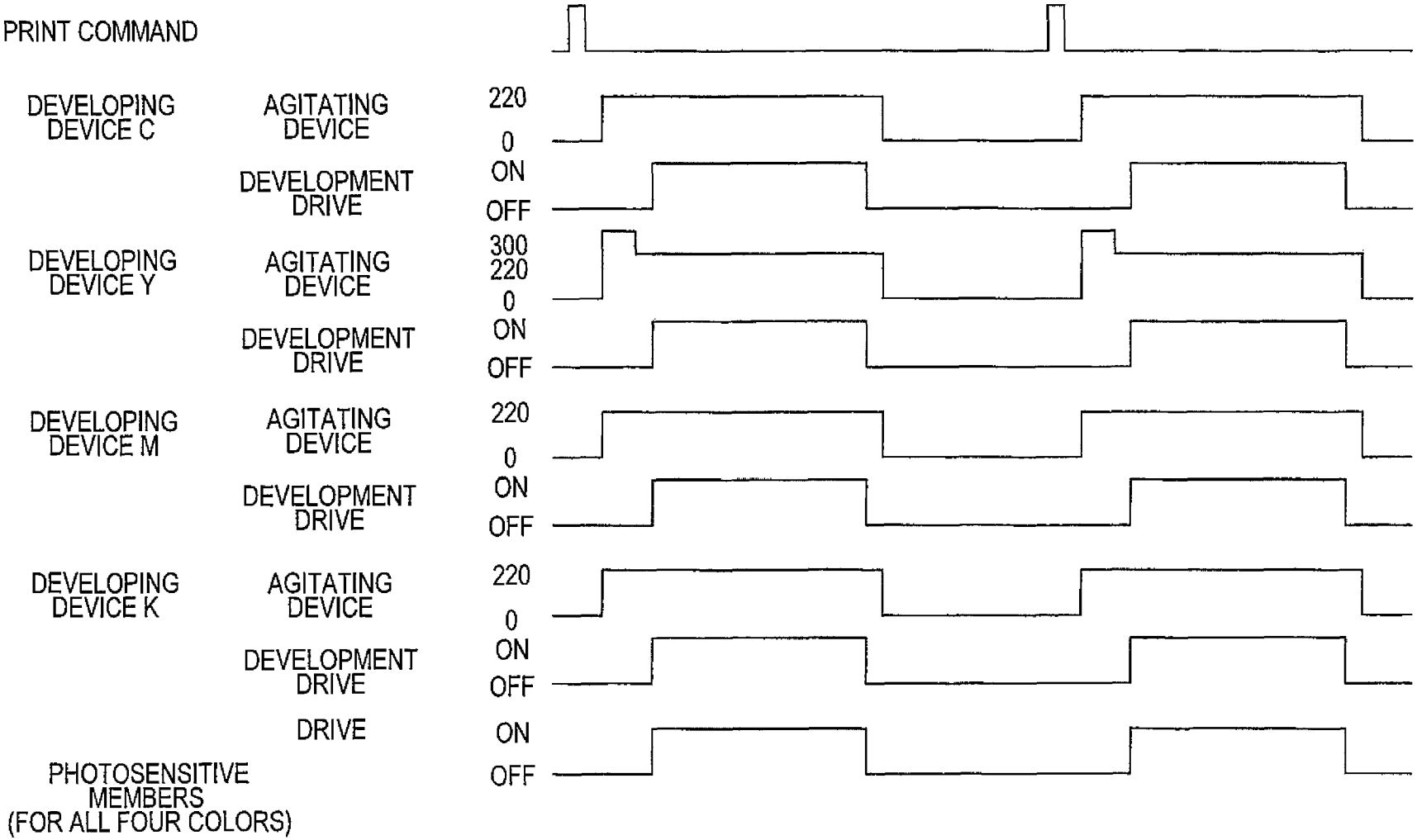
FIG. 7 is a diagram showing an example of a timing chart in the color image forming apparatus of an embodiment of the invention.

In a case shown in FIG. 7, for example, in the Y developing device having the longest stabilization time, the liquid developer is agitated in a short time at the number of revolutions, for example, 300 mm/s higher than the number of revolutions (220 mm/s) of the agitating screw during a print operation. By setting the numbers of revolutions of the agitating screws changeable, it is possible to set stabilization times of the liquid developers of the respective colors the same.

In the case of the C developing device, when a print command is issued, the cyan liquid developer is agitated at the number of revolutions of 220 mm/s. After the agitation is continued for, for example, a fixed time and the viscosity in the cyan liquid developer is stabilized, the developing roller 21 is driven and a development operation is started. When the development operation is finished, the driving of the developing roller 21 is turned off and, then, the driving of the agitating screw 32 is turned off. The same operations are performed in the M developing device and the K developing device.

In the Y developing device, when a print command is issued, the yellow liquid developer is agitated at the number of revolutions of 300 mm/s. Subsequently, the number of revolutions is changed to 220 mm/s and the viscosity in the yellow liquid developer is stabilized in a total agitation time same as that of the other developing devices.

In color development of the four colors, when a print command is issued, first, the number of revolutions in the Y developing device is set to 300 mm/s and the numbers of revolutions in the C developing device, the M developing device, and the K developing device are simultaneously set to 220 mm/s. Subsequently, it is advisable to appropriately adjust the number of revolutions in the Y developing device, for example, reduce the number of revolutions to 220 mm/s to set agitation times in all the developing devices the same. Consequently, developing operations can be simultaneously started for the respective colors. The photosensitive members 11 for all the four colors are brought into a driving state simultaneously with the development operation of the respective developing devices.

The invention is explained in detail below with reference to examples.

Example 1

Preparation of a Basic Processed Pigment

A cyan pigment (a phthalocyanine pigment, Pigment Blue 15:3) is processed to be mixed with a mixture of polyester resin (manufactured by Dainippon Ink and Chemicals, Incorporated, Plasdic DL-90) and a basic polymeric dispersant (manufactured by Ajinomoto-Fine-Techno Co., Ajisper PB-822) at a ratio of cyan pigment:mixture (weight ratio)= 35:65. After the cyan pigment was dispersed and mixed by a bead mill in methyl ethyl ketone, the cyan pigment was deposited in a water system, desolvated, dried, and pulverized to be a basic processed pigment.

Preparation of a Cyan Liquid Developer 450 g of zirconia balls having a diameter of 5 millimeters were put in a stainless steel container having a capacity of 500 ml together with a composition of 150 g of an MO sunflower oil (manufactured by Nisshin Oillio Group, Ltd., an oleic acid component amount of triglyceride 60.5%), 50 g of oleic acid (manufactured by Kanto Chemical Co., Inc.), 0.11 g of an acid dispersant (manufactured by Ajinomoto-Fine-Techno Co., Ajisper PA111), and 35 g of the basic processed pigment prepared as described above, dispersed and mixed for 24 hours at the number of revolutions 504 ppm using an agitator (a propeller blade of a tornado SM type), and a cyan liquid developer as a colorant dispersion is prepared.

The obtained cyan liquid developer had a toner density of 14.9 mass %, viscosity (at 25° C.) of 990 mPa·s in a state left untouched for 8 hours or more, an electric resistance of $3.5\times10^{12}$ Ω·cm at 25° C., and a primary particle diameter (an average particle diameter) of colored particulates of 1.1 μm.

The cyan liquid developer in the state left untouched for 8 hours or more was put in the developing device shown in FIG. 2 and subjected to a shearing force at agitation speed of 220 mm/s. Agitation was stopped at every agitation time of 10 seconds, 20 seconds, 30 seconds, 40 seconds, 50 seconds, 60 seconds, and 120 seconds. The viscosity of the liquid developer at each elapsed time was measured using "VM-100A" manufactured by CBC Co., Ltd. in a test chamber having the temperature of 25° C. and the humidity of 49%. A result of the measurement is shown in FIG. 1A.

From FIG. 1A, it is seen that the viscosity of the obtained cyan liquid developer was changed from 990 mPa·s to 885 mPa·s in 20 seconds and stabilized.

Preparation of a Yellow Liquid Developer

A basic processed pigment was prepared in the same manner as the preparation of the basic processed pigment described above except that Pigment Yellow 74 as a yellow pigment was used instead of the cyan pigment. A yellow liquid developer was prepared in the same manner as the preparation of the cyan liquid developer using this basic processed pigment.

The obtained yellow liquid developer had a toner density of 14.9 mass %, viscosity (at 25° C.) of 300 mPa·s in a state left untouched for 8 hours or more, an electric resistance of $6.1\times10^{12}$ Ω·cm at 25° C., and a primary particle diameter (an average particle diameter) of colored particulates of 1.1 μm.

The yellow liquid developer in the state left untouched for 8 hours or more was put in the developing device shown in FIG. 2 and subjected to a shearing force at agitation speed of 220 mm/s. Agitation was stopped at every agitation time of 10 seconds, 20 seconds, 30 seconds, 40 seconds, 50 seconds, and 60 seconds. The viscosity of the liquid developer at each elapsed time was measured using "VM-100A" manufactured by CBC Co., Ltd. in a test chamber having the temperature of 25° C. and the humidity of 49%. A result of the measurement is shown in FIG. 1B.

From FIG. 1B, it is seen that the viscosity of the obtained yellow liquid developer was changed from 300 mPa·s to 200 mPa·s in 30 seconds and stabilized.

Preparation of a Magenta Liquid Developer

A basic processed pigment was prepared in the same manner as the preparation of the basic processed pigment described above except that Pigment Red 57:1 as a magenta pigment was used instead of the cyan pigment. A magenta liquid developer was prepared in the same manner as the preparation of the cyan liquid developer using this basic processed pigment.

The obtained magenta liquid developer had a toner density of 14.9 mass %, viscosity (at 25° C.) of 390 mPa·s in a state left untouched for 8 hours or more, an electric resistance of $4.6\times10^{12}$ Ω·cm at 25° C. and a primary particle diameter (an average particle diameter) of colored particulates of 1.1 μm.

The magenta liquid developer in the state left untouched for 8 hours or more was put in the developing device shown in FIG. 2 and subjected to a shearing force at agitation speed of 220 mm/s. The viscosity of the liquid developer at each elapsed time of agitation time was measured using "VM-100A" manufactured by CBC Co., Ltd. in a test chamber having the temperature of 25° C. and the humidity of 49% in the same manner as the measurement of the cyan liquid developer. As result of the measurement, it was found that the viscosity of the obtained magenta liquid developer was changed from 390 mPa·s to 300 mPa·s in 20 seconds and stabilized.

Preparation of a Black Liquid Developer

A basic processed pigment was prepared in the same manner as the preparation of the basic processed pigment described above except that carbon black (a particle diameter 40 nm and a nitrogen absorption specific surface area 55 $m^2/g$) as a black pigment was used instead of the cyan pigment. A black liquid developer was prepared in the same manner as the preparation of the cyan liquid developer using this basic processed pigment.

The obtained black liquid developer had a toner density of 14.9 mass %, viscosity (at 25° C.) of 560 mPa·s in a state left untouched for 8 hours or more, an electric resistance of $1.1\times10^{12}$ Ω·cm at 25° C., and a primary particle diameter (an average particle diameter) of colored particulates of 1.1 μm.

The black liquid developer in the state left untouched for 8 hours or more was put in the developing device shown in FIG. 2 and subjected to a shearing force at agitation speed of 220 mm/s. The viscosity of the liquid developer at each elapsed time of agitation time was measured using "VM-100A" manufactured by CBC Co., Ltd. in a test chamber having the temperature of 25° C. and the humidity of 49% in the same manner as the measurement of the cyan liquid developer. As result of the measurement, it was found that the viscosity of the obtained black liquid developer was changed from 560 mPa·s to 450 mPa·s in 20 seconds and stabilized.

In the tandem printer shown in FIG. 3, the liquid developers of the respective colors prepared as described above were set in the respective developer containers. As image forming conditions, the photosensitive members were uniformly charged at 800 V, process speed was 206 m/min, a charging voltage was 5 kV, a development bias was 350 V, a toner layer thickness on the developing rollers was regulated to 10 μm, a primary transfer voltage was 300 V, and a secondary transfer voltage was 1.5 kV. An image was transferred onto transfer paper for liquid development ("EP-L Ultra Lightweight Coating 81.4 gsm" manufactured by Mitsubishi Paper Mills, Ltd.) and fixed (a fixing roller temperature 120° C.). In regulating the toner layer thickness on the developing rollers to 10 μm, a groove pitch in the anilox roller in the cyan liquid developing means was set to 100 μm and a groove depth therein was set to 20 μm, a groove pitch in the anilox roller in the yellow liquid developing means was set to 100 μm and a groove depth therein was set to 30 μm, a groove pitch in the anilox roller in the magenta liquid developing means was set to 100 μm and a groove depth therein was set to 28 μm, and a groove pitch in the anilox roller in the black liquid developing means was set to 100 μm and a groove depth therein was set to 25 μm. In the respective developing devices, the agitating devices for the liquid developers and the developing rollers were driven in association with each other. The developing rollers were arranged to be capable of being separated from and brought into contact with the photosensitive members by the separation and contact mechanisms.

As indicated by a timing chart shown in FIG. 4, the developing rollers and the photosensitive members were separated from each other. When a print command was issued, first, the agitating screw in the Y developing device having the longest color stabilization time was driven. Subsequently, the agitating screws in the C developing device, the M developing device, and the K developing device were driven. The agitating screw was driven for 30 seconds in the Y developing device. The agitating screws were driven for 20 seconds in the C developing device, the M developing device, and the K developing device. All the developing rollers were brought into contact with the photosensitive members in the driving state by the separation and contact mechanisms. Electrostatic latent images on the respective photosensitive members were developed. Printing was performed using a print pattern including color images of 5% of the respective colors to obtain a color image excellent in color balance on transfer paper.

Example 2

This example is an example of development performed according to a timing chart shown in FIG. 5. In the respective developing devices in the tandem printer shown in FIG. 3, the Example 2 is the same as the Example 1 except that the driving mechanisms of the agitating devices in the respective liquid development containers and the driving mechanisms of the developing rollers are separately provided to allow the driving mechanisms to operate independently from each other and the developing rollers are always in contact with the photosensitive members.

As shown in FIG. 5, when a print command was issued, first, the agitating screw in the Y developing device having the longest color stabilization time was driven. Subsequently, the agitating screws in the C developing device, the M developing device, and the K developing device were driven. The agitating screw was driven for 30 seconds in the Y developing device. The agitating screws were driven for 20 seconds in the C developing device, the M developing device, and the K developing device. The photosensitive members of all the four colors were driven and electrostatic latent images on the respective sensitive members were developed by all the developing rollers. Printing was performed in the same manner as the printing in the Example 1 to obtain a color image excellent in color balance on transfer paper.

Example 3

This example is an example of development performed according to a timing chart shown in FIG. 6. This example is another example of the form in the Example 2. First, the developing screws in the respective developing devices were driven at 50 mm/s and brought into a standby state. When a print command was issued, the number of revolutions of the agitating screw in the Y developing device driven on standby at 50 mm/s was changed to 220 mm/s. The agitation was continued for 30 seconds. When the number of revolutions of the agitating screws in the Y developing device was changed, after 10 seconds, the numbers of revolutions of the agitating screws in the C developing device, the M developing device, and the K developing device driven on standby at 50 mm/s were changed to 220 mm/s. The agitation was continued for 20 seconds. The photosensitive members of all the four colors were driven and electrostatic latent images on the respective sensitive members were developed by all the developing rollers. Printing was performed in the same manner as the printing in the Example 1 to obtain a color image excellent in color balance on transfer paper.

Example 4

This example is an example of development performed according to a timing chart shown in FIG. 7. This example is still another example of the form in the Example 2. When a print command was issued, after the agitating screw in the Y developing device was driven at the number of revolutions of 300 mm/s for 5 seconds, the number of revolutions was changed to 220 mm/s. The agitation was continued for 15 seconds. In the C developing device, the M developing device, and the K developing device, the numbers of revolutions of the respective agitating screws were set to 220 mm/s and the agitating screws were driven for 20 seconds. The photosensitive members of all the four colors were driven and electrostatic latent images on the respective sensitive members were developed by all the developing rollers. Printing was performed in the same manner as the printing in the Example 1 to obtain a color image excellent in color balance on transfer paper.

What is claimed is:

1. A color image forming apparatus comprising, for each of liquid developers of plural colors:

a photosensitive member;

a developing roller;

an agitating device that agitates a liquid developer having a viscosity characteristic dependent on a shearing force; and a developer supplying unit that supplies the liquid developer to the developing roller, wherein in development, agitation start timing is varied depending on the color of the liquid developer, image formation is started after agitation of the liquid developer, and agitation of a liquid developer of a color having a longer stabilization time than that of another color is started earlier to stabilize viscosity in the liquid developer.

2. The color image forming apparatus according to claim 1, wherein the developing roller is driven in association with the agitating device, separated from the photosensitive member during non-development, and, during development, brought into contact with the photosensitive member after the viscosities in the liquid developers of the plural colors are stabilized.

3. The color image forming apparatus according to claim 1, wherein the developing roller is in contact with the photosensitive member.

4. The color image forming apparatus according to claim 1, wherein, during standby before development, an agitation speed of an agitating member in the agitating device is lower than an agitation speed of the agitating member during image formation.

5. The color image forming apparatus according to claim 1, wherein an agitation speed of the liquid developer having a first transition time for transition of the liquid developer to stabilized viscosity is higher than an agitation speed of the liquid developer having a second transition time for transition to stabilized viscosity shorter than the first transition time.

6. The color image forming apparatus according to claim 1, wherein agitation speeds of the agitating devices of the respective colors are the same.

7. The color image forming apparatus according to claim 1, wherein the developer supplying unit has an anilox roller for supplying the liquid developer to the developing roller, irregularities are provided on the surface of the anilox roller, and a film thickness of the liquid developer on the developing roller is adjusted according to viscosity of the liquid developer stabilized by the agitating device.

8. The color image forming apparatus according to claim 1, wherein the liquid developers are liquid developers of cyan, magenta, yellow, and black obtained by dispersing a basic processed pigment in a vegetable oil according to an acid-base interaction.

9. The color image forming apparatus according to claim 8, wherein viscosities (at 25° c.) of the respective developers of cyan, magenta, yellow, and black are 100 mPa·s to 1500 mPa·s.

10. A color image forming method in a color image forming apparatus including, for each of liquid developers of plural colors, a photosensitive member, a developing roller, an agitating device that is driven in association with the developing roller and agitates a liquid developer having a viscosity characteristic dependent on a shearing force, and a developer supplying unit that supplies the liquid developer to the developing roller, the color image forming method comprising:

during development, supplying the respective developers to respective developing rollers after starting the agitation of the liquid developer, and starting agitation of a liquid developer of a color having a longer stabilization time than that of another color earlier to stabilize viscosities in the liquid developers of the plural colors;

separating the developing roller from the photosensitive member during non-development; and during development, bringing the developing roller into contact with the photosensitive member to develop an electrostatic latent image after changing the viscosities in the liquid crystal developers of the plural colors to printable viscosities.

11. A color image forming method in a color image forming apparatus including, for each of liquid developers of plural colors, a photosensitive member, a developing roller that comes into contact with the photosensitive member, an agitating device that is driven in association with the developing roller and agitates a liquid developer having a viscosity characteristic dependent on a shearing force, and a developer supplying unit that supplies the liquid developer to the developing roller, the color image forming method comprising, during development, supplying the respective developers to respective developing rollers after starting the agitation of the liquid developer, and starting agitation of a liquid developer of a color having a longer stabilization time than that of another color earlier to stabilize viscosities in the liquid developers of the plural colors.

12. The color image forming apparatus according to claim 1, wherein the developing rollers of each of the liquid developers of the plural colors are driven to start simultaneously.

* * * * *